US007495187B2

(12) United States Patent
Sallam et al.

(10) Patent No.: US 7,495,187 B2
(45) Date of Patent: Feb. 24, 2009

(54) ELECTRICAL SWITCH

(75) Inventors: Faisal K. Sallam, Dearborn, MI (US); Mark G. Feldman, Farmington Hills, MI (US); Brian R. Masters, Hartland, MI (US); Bruce Pierik, Hazel Park, MI (US)

(73) Assignee: Lear Corporation, Southfield, MI (US)

( * ) Notice: Subject to any disclaimer, the term of this patent is extended or adjusted under 35 U.S.C. 154(b) by 559 days.

(21) Appl. No.: 11/162,241

(22) Filed: Sep. 2, 2005

(65) Prior Publication Data

US 2007/0051606 A1 Mar. 8, 2007

(51) Int. Cl.
*H01H 19/14* (2006.01)

(52) U.S. Cl. ..... 200/11 R; 200/564; 200/336; 200/1 V

(58) Field of Classification Search ..... 200/336, 200/11 DA, 11 R, 11 C, 11 E, 11 J, 11 K, 200/1 V, 564, 570, 567
See application file for complete search history.

(56) References Cited

U.S. PATENT DOCUMENTS

| | | | | |
|---|---|---|---|---|
| 4,107,500 | A * | 8/1978 | Distler et al. | 200/308 |
| 4,424,424 | A | 1/1984 | Hollenbeck, Jr. | |
| 4,625,084 | A | 11/1986 | Fowler et al. | |
| 4,754,104 | A | 6/1988 | Maltais et al. | |
| 4,906,808 | A | 3/1990 | Burgess et al. | |
| 5,001,316 | A | 3/1991 | Salaman | |
| 5,743,387 | A | 4/1998 | Hung | |
| 6,225,580 | B1 | 5/2001 | Lemire | |
| 6,448,523 | B1 * | 9/2002 | Aizawa | 200/564 |
| 6,674,183 | B1 | 1/2004 | Noda et al. | |
| 7,082,669 | B2 * | 8/2006 | Imamura | 29/595 |
| 2004/0041086 | A1 * | 3/2004 | Imamura | 250/231.14 |

FOREIGN PATENT DOCUMENTS

| | | | |
|---|---|---|---|
| EP | 0 269 584 | A3 | 6/1988 |
| WO | 2006/024589 | A1 | 3/2006 |

OTHER PUBLICATIONS

Search Report for Application No. GB0617028.6; Dated Nov. 21, 2006; 2 pages.

* cited by examiner

*Primary Examiner*—Elvin G Enad
*Assistant Examiner*—Marina Fishman
(74) *Attorney, Agent, or Firm*—Brooks Kushman P.C.

(57) ABSTRACT

An electrical switch having a plurality of switch positions includes a plurality of first electrical contacts, and a second electrical contact configured to electrically connect at least two of the first contacts. A carrier member is configured to carry the second contact, and a knob is used to facilitate selection of the switch positions. The knob is configured to cooperate with the carrier member so that moving the knob from one switch position to another results in a related movement of the carrier member and the second contact. A first biasing member, which is electrically isolated from all of the electrical contacts, is configured to bias at least a portion of the second contact toward the first contacts to facilitate an electrical connection therebetween.

20 Claims, 2 Drawing Sheets

ELECTRICAL SWITCH

BACKGROUND OF THE INVENTION

1. Field of the Invention

The present invention relates to an electrical switch.

2. Background Art

Electrical switches are used in many different types of electrical and mechanical-electrical devices, including devices and systems within vehicles. With an ever increasing need to keep the cost of materials and production down, even relatively inexpensive items, such as electrical switches, are being targeted for cost savings. For example, reducing the total number of pieces in a switch, or making it easier to assemble, are two ways in which the overall cost of the switch may be reduced. One of the issues faced by any designer is the problem of determining tolerances for mating parts. Tolerances must be tight enough such that mating parts function properly together, while at the same time, not so tight that manufacturing costs are prohibitive. Moreover, the greater the number of parts, the greater the potential for tolerance stack-up problems.

In the case of electrical switches, it is important that the electrical contacts within the switch will properly engage each other to ensure completion of an electrical circuit. One way to help ensure that the electrical contacts form a good electrical connection is to provide a spring element against one of the contacts to force it against the other contact. One such switch is described in U.S. Pat. No. 4,424,424 issued to Hollenbeck Jr. on Jan. 3, 1984. Hollenbeck Jr. describes a boat battery selector switch which includes a rotary contact which is maintained in compressive contact with other contacts in the switch via a washer and coil spring. One limitation of the switch described in Hollenbeck Jr. is that the spring is in direct contact with the electrical contact itself. This means that any current flowing through the contacts also flows through the spring. The spring is also in contact with a knob utilized by an operator of the switch. Another limitation is that the knob is attached to the switch via a threaded fastener and washer, which requires a cumbersome and time-consuming assembly process. In addition, the rotary contact slides over a portion of the knob, such that even if the coil spring were isolated from the contacts, the knob would still be subject to whatever current flowed through the contacts.

Therefore, it would be desirable to have an electrical switch that was easily assembled such that threaded fasteners were not required to attach the knob, and tolerance stack-up issues were reduced or eliminated through the use of appropriate contact carriers and/or biasing members to maintain an electrical connection between the contact elements of the switch, without requiring unreasonably tight tolerances. It would further be desirable to have a switch in which such biasing elements and the electrical contacts were all electrically insulated from the knob.

SUMMARY OF THE INVENTION

The present invention provides an electrical switch having a plurality of switch positions. The switch includes a plurality of first electrical contacts, and a second electrical contact configured to electrically connect at least two of the first contacts. A carrier member is configured to carry the second contact, and a knob is operable by an operator of the switch to facilitate selection of the switch positions. The knob is configured to cooperate with the carrier member such that movement of the knob from one of the switch positions to another of the switch positions results in a related movement of the carrier member and the second contact. A first biasing member is electrically isolated from each of the electrical contacts, and is configured to bias at least a portion of the second contact toward the at least two first contacts to facilitate an electrical connection therebetween.

The invention also provides an electrical switch having a second contact which includes a plurality of second contact members, each of which is configured to cooperate with at least one first electrical contact for making an electrical connection between at least two of the first contacts. An electrically insulating carrier member is configured to carry the second contact. A knob is operable by an operator of the switch to facilitate selection of the switch positions, and is configured to cooperate with the carrier member such that movement of the knob from one of the switch positions to another of the switch positions results in a related movement of the carrier member and the second contact. The knob is electrically insulated from the second contact by the carrier member. A biasing member is disposed between the knob and the carrier member, and is configured to impart a contact force to the second contact through the carrier member. The contact force has a direction and magnitude sufficient to maintain electrical contact between the second contact member and the at least two first contacts.

The invention further provides a rotary electrical switch having a plurality of switch positions. The switch includes a rotatable knob for selecting the switch positions. A cavity having an open end and a closed end is disposed within the knob. The rotary electrical switch also includes a circuit board and a plurality of stationary first contacts disposed in the circuit board. A second contact includes a plurality of contact arms configured to move relative to the first contacts when the knob is rotated, and to electrically connect at least two of the first contacts when the knob is rotated to a predetermined position. An electrically insulating carrier member includes an elongate portion at least partially disposed and linearly movable within the knob cavity. The carrier member cooperates with the second contact and the knob such that rotation of the knob to select the switch positions effects an associated rotation of the second contact arms. A biasing member is disposed in the knob cavity between the closed end of the cavity and the elongate portion of the carrier member for imparting a contact force to the second contact through the carrier member. This facilitates electrical contact between the second contact arms and the first contacts.

DETAILED DESCRIPTION OF THE PREFERRED EMBODIMENT(S)

Figure 1:
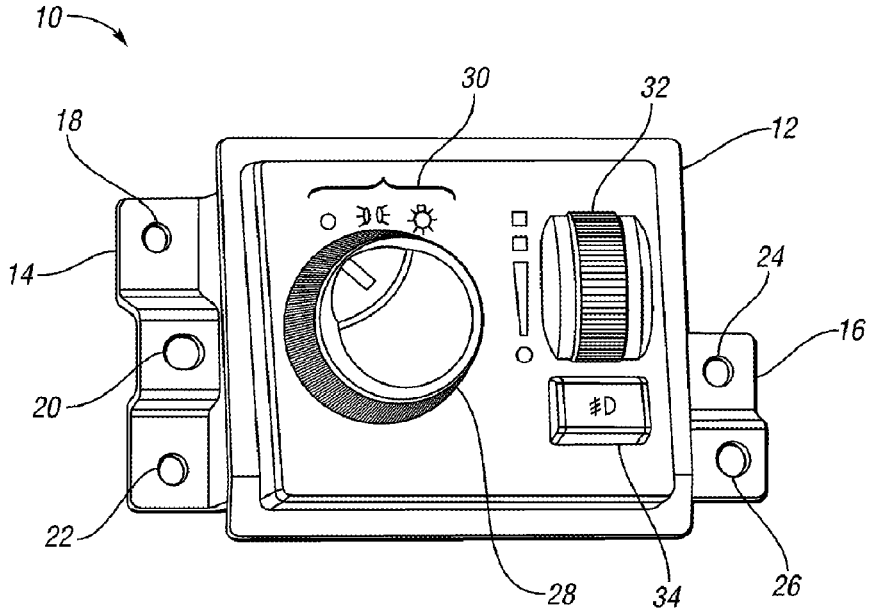
FIG. 1 is a perspective view of an electrical switch in accordance with one embodiment of the present invention.

FIGS. 1 shows an electrical switch 10 in accordance with one embodiment of the present invention. The switch 10 is a compact device contained within a housing 12 having a pair of flanges 14, 16, for mounting the switch 10 to a support structure. Each of the flanges 14, 16 includes a number of apertures 18, 20, 22, 24, 26 disposed therethrough to receive a fastening element. The switch 10 is a type which may be conveniently used in a vehicle, for example, as a headlamp switch. The switch 10 includes a rotatable knob 28 which can be rotated to select a variety of switch positions, indicated by the icons 30 on the housing 12. The housing 12 may be conveniently made by an injection molding process, and it may be particularly convenient to use a polycarbonate (PC) material that is translucent, so that the icons 30 can be backlit for easy viewing by the vehicle operator during times of limited ambient light.

Figure 2:
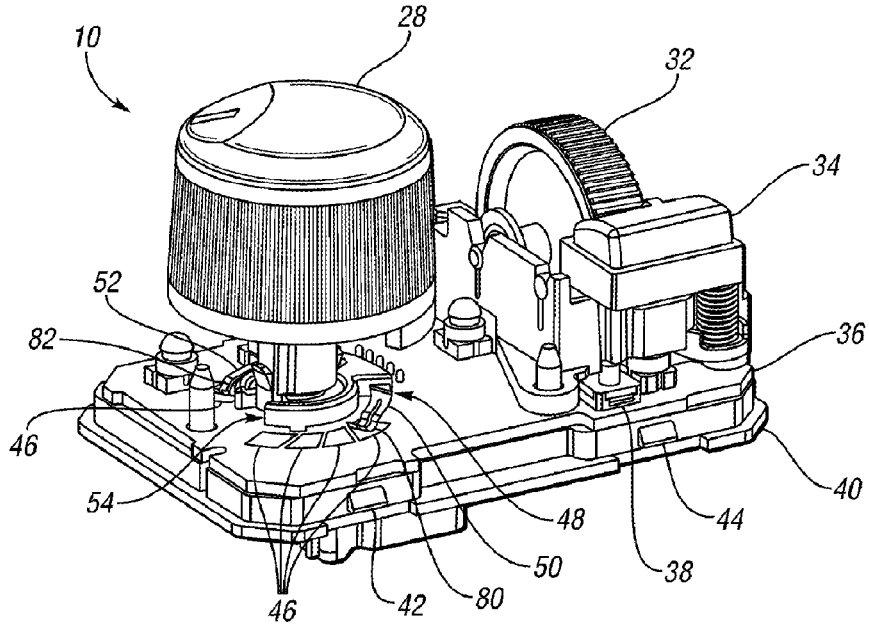
FIG. 2 is a perspective view of the electrical switch shown in FIG. 1, having the switch housing removed.

To further facilitate use of the space and components of the switch 10, a second rotary knob 32 and a push button 34 are used to respectively operate a headlamp dimmer mechanism and fog lights. The knob 32 and push button 34 are also shown in FIG. 2, where the housing 12 is removed from the switch 10, revealing some of the components inside the switch. The dimmer knob 32 can be used to rotate a smaller carrier (not visible) which interfaces with a printed circuit (PC) board 36 to vary the intensity of the vehicle headlamps, in a manner well known in the art. In addition, the pushbutton 34 actuates a switch 38 also attached to the PC board 36 to actuate the vehicle fog lamps. Also shown in FIG. 2 is a cover 40 which is attached to the PC board 36, and is configured with tabs 42, 44 which provide snap-on attachment for the housing 12. The cover 40 cooperates with the housing 12 to enclose the PC board 36 and other electrical components described below.

Directly below the knob 28 is a plurality of first electrical contacts 46 (not all of which are visible in FIG. 2), which are stationary, and disposed within the PC board 36. Making electrical contact with at least two of the first contacts 46, is a second contact 48, which includes contact members, or contact arms 50, 52. Each of the contact arms 50, 52 are configured as leaf springs, cantilevered at a carrier member 54 at one end and disposed to contact the first contacts 46 at the other end. As explained more fully below, the carrier member 54 carries the second contact 48, and electrically isolates the knob 28 from the electrical contacts 46, 48.

Figure 3:
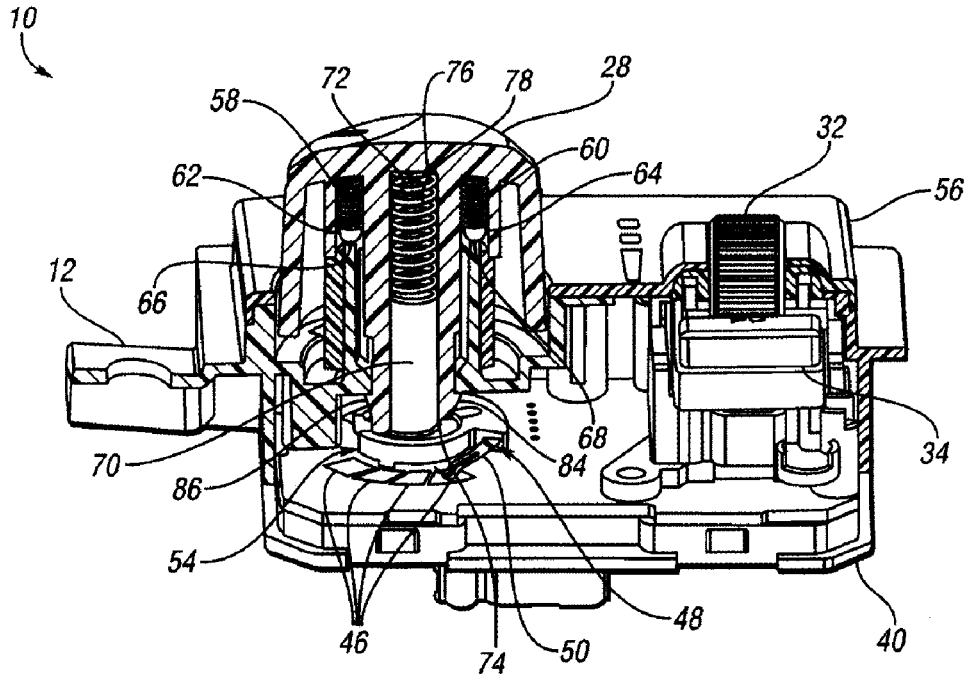
FIG. 3 is a partially sectional view of the electrical switch shown in FIG. 1.

FIG. 3 shows a cross-sectional view of the switch 10. As shown in FIG. 3, the housing 12 includes a separate housing cover 56 which may be convenient to use so that the cover 56 can be made from a translucent material to facilitate backlighting of the icons 30, while the remainder of the housing 12 can be made from an opaque material so that light generated inside the housing 12, for example by a light-emitting diode (LED) disposed on the PC board 36, is only visible from the top of the switch 10, through the cover 56.

As shown in FIG. 3, the knob 28 houses a pair of small springs 58, 60 which respectively apply pressure to ball bearings 62, 64, to facilitate proper positioning of the knob 28 when the different switch positions are selected. The ball bearings 62, 64 interface with detents 66, 68 in the housing 12. Also shown in FIG. 3 is the carrier member 54 and how it interfaces with the knob 28. The carrier member 54 includes an elongate portion 70 which is disposed within a cavity 72 within the knob 28. The cavity 72 includes an open end 74 through which the elongate portion 70 of the carrier member 54 is easily inserted. The cavity 72 also includes a closed end 76 which, as explained more fully below, helps to provide a reaction force for maintaining a contact force on the second contact 48.

Also shown in FIG. 3 is a first biasing member 78 which is disposed in the cavity 72 between the closed end 76 and the elongate portion 70 of the carrier member 54. The first biasing member 78 is, in the embodiment shown in FIG. 3, a coil spring which is used to impart a contact force to the second contact 48 through the carrier member 54. Because the carrier member 54 is made from a non-conductive material, both the spring 78 and the knob 28 are electrically isolated from the first and second electrical contacts 46, 48. The elongate portion 70 of the carrier member 54 is free to move linearly within the cavity 72.

Thus, installing the spring 78 in the cavity 72 such that its length is shortened from its natural length—i.e., it is in compression—allows the spring 78 to urge the carrier member 54, and thus the second contact 48, downward toward the first contacts 46. This configuration provides an advantage over switches which would have the carrier member attached directly to the knob, because such an arrangement would require the knob, housing, carrier member and second contact to be manufactured so that when they were assembled in a fixed position, the second contact was positioned appropriately to make an electrical connection with the first contacts. The linearly free floating carrier member 54 of the present invention eliminates this problem with tolerance stack-up, and also electrically insulates the knob and the spring 78 from the electrical contacts 46, 48.

In addition to providing a contact force between the first and second contacts 46, 48 via the coil spring 78, each of the contact arms 50, 52 acts as a second biasing member, which also help to maintain an electrical connection between the first and second electrical contacts 46, 48. In particular, the contact arms 50, 52 act as flexible cantilevered beams having respective distal ends 80, 82 (see FIG. 2) electrically connected with a corresponding one of the first electrical contacts 46. Thus, the electrical switch 10 includes a plurality of biasing members which help to maintain an electrical connection between the contacts 46, 48.

In order to facilitate ease of assembly, and also maintain the knob 28 in its position when subjected to the force of the spring 78—and to a lesser extent the force of the springs 58, 60—the knob 28 is configured with locking tabs 84, 86 which, as shown in FIG. 3, cooperate with a portion of the housing 12 to maintain the knob 28 in its linear position. Moreover, as shown in FIG. 3, the locking tabs 84, 86 are each configured with a generally sloped surface which facilitates easy insertion of the knob 28 into the housing 12 to facilitate fast and efficient assembly. The cooperation of the locking tabs 84, 86 and the housing 12 provide a reaction force to the spring 78 as it imparts a contact force to the second contact 48. The contact force has a generally downward direction as oriented in FIG. 3, and the spring 78 is chosen such that the magnitude of the contact force is sufficient to maintain electrical contact between the first and second contacts 46, 48. In the presence of the contact force, the contact arms 50, 52 are configured to deflect, thereby working to bias the second contact 48 away from the first contacts 46 while the contact force is applied by the spring 78. The contact force provided by the spring 78 is generally along an axis parallel to the longitudinal axis of the cavity 72.

As noted above, the locking tabs 84, 86 cooperate with the housing 12 to inhibit linear movement of the knob 28 in a direction opposite the contact force. Conversely, the carrier member 54 is free to move in a linear direction along the axis of the cavity 72—i.e., along a line defied by the contact force—which facilitates transfer of the contact force from the spring 78 to the second contact 48. Although free to move linearly, the carrier member 54 is configured to cooperate with the knob 28, such that rotation of the knob 28 also causes rotation of the carrier member 54, thereby moving the contact arms 50, 52 to electrically connect different ones of the first contacts 46.

Figure 4:
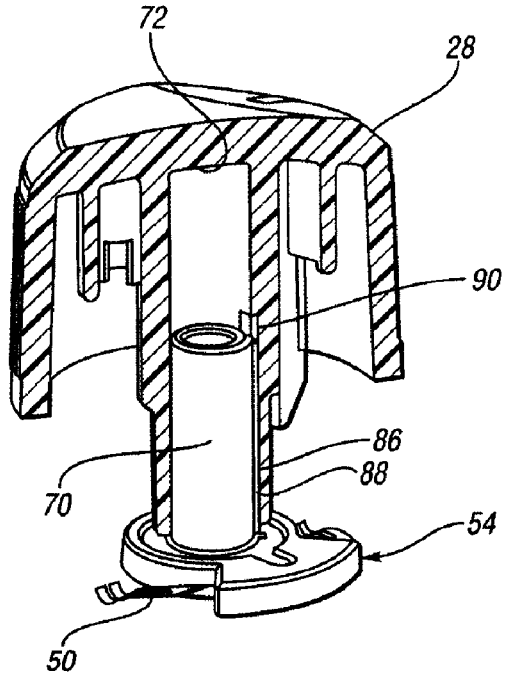
FIG. 4 is a partially sectional view of the knob and carrier components of the electrical switch.

FIG. 4 illustrates one such arrangement for mating the rotation of the knob 28 and the carrier 54. As shown in FIG. 4, the elongate portion 70 of the carrier member 54 includes a projection 88 along at least part of its length. To cooperate with the projection 88, the cavity 72 of the knob 28 includes a channel 90 which is configured to receive the projection 88 to facilitate substantially synchronous rotational movement of the knob 28 and the carrier member 54. Thus, the configuration of the switch 10 causes the knob 28 and the carrier member 54 to rotate together, but allows the carrier member 54 to free float linearly within the knob 28. This reduces problems associated with tolerance stack-ups, while providing assurance that the electrical contacts will maintain an appropriate electrical connection. The use of the carrier member 54 also isolates the switch knob 28 from the electrical contacts to provide additional benefit.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electrical switch having a plurality of switch positions, the switch comprising:

a plurality of first electrical contacts;

a second electrical contact configured to electrically connect at least two of the first contacts;

a carrier member configured to carry the second contact;

a knob for facilitating selection of the switch positions, the knob being configured to cooperate with the carrier member such that movement of the knob from one of the switch positions to another of the switch positions results in a related movement of the carrier member and the second contact such that when the knob is in a first position, the second contact closes a first switch and when the knob is in a second position, the second contact closes a second switch; and a first biasing member electrically isolated from each of the electrical contacts and configured to bias at least a portion of the second contact toward the at least two first contacts to facilitate an electrical connection therebetween.

2. The electrical switch of claim 1, further comprising a pair of second biasing members configured to bias the second contact away from the at least two first contacts when the first biasing member biases second contact toward the at least two first contacts.

3. The electrical switch of claim 2, wherein the second biasing members form a portion of the second contact, and each of the second biasing members is configured to make electrical contact with at least one corresponding first contact.

4. The electrical switch of claim 3, wherein the first biasing member is a coil spring and each of the second biasing members is a leaf spring.

5. The electrical switch of claim 4, wherein the knob includes a cylindrical cavity configured to receive a portion of the carrier member therein, and wherein the first biasing member is disposed in the cavity in contact with the carrier member portion, thereby biasing the carrier member away from the knob.

6. The electrical switch of claim 5, wherein the carrier member is electrically insulating, thereby electrically isolating the first biasing member from the second contact.

7. The electrical switch of claim 6, wherein the carrier member portion and knob cavity are configured to cooperate such that the carrier member portion can move linearly within the cavity relative to the knob, and rotation of the knob around a longitudinal axis of the cavity causes an associated rotation of the carrier member.

8. The electrical switch of claim 7, further comprising a housing configured to inhibit linear movement of the knob along the longitudinal axis of the cavity in a direction away from the first biasing member, the housing being further configured to facilitate rotational movement of the knob relative to the housing.

9. The electrical switch of claim 8, further comprising a circuit board having the first contacts disposed therein, and a cover configured to cooperate with the housing to at least substantially enclose the circuit board, the carrier member, and the second contact.

10. An electrical switch having a plurality of switch positions, the switch comprising:

a plurality of first electrical contacts;

a second electrical contact configured to electrically connect at least two of the first contacts, the second contact including a plurality of second contact members each being configured to cooperate with at least one of the first contacts for making the electrical connection between the at least two first contacts;

an electrically insulating carrier member configured to carry the second contact;

a knob for facilitating selection of the switch positions, the knob being configured to cooperate with the carrier member such that movement of the knob from one of the switch positions to another of the switch positions results in a related movement of the carrier member and the second contact such that when the knob is in a first position, the second contact closes a first switch and when the knob is in a second position, the second contact closes a second switch, the knob being electrically insulated from the second contact by the carrier member; and a biasing member disposed between the knob and the carrier member and configured to impart a contact force to the second contact through the carrier member, the contact force having a direction and magnitude sufficient to maintain electrical contact between the second contact members and the at least two first contacts.

11. The electrical switch of claim 10, wherein the knob and carrier member cooperate such that the carrier member is movable relative to the knob along a line defined by the contact force.

12. The electrical switch of claim 10, wherein each of the second contact members includes a flexible cantilevered beam, each of the beams being configured to deflect in response to a reaction force from a corresponding one of the first contacts.

13. The electrical switch of claim 10, further comprising a housing configured to cooperate with the knob to provide a reaction force to the biasing member when the biasing member imparts the contact force to the second contact through the carrier member, the knob being movable within the housing from one of the switch positions to another of the switch positions.

14. The electrical switch of claim 13, further comprising a circuit board having the first contacts disposed therein, and a cover configured to cooperate with the housing to at least substantially enclose the circuit board, the carrier member, and the second contact.

15. A rotary electrical switch having a plurality of switch positions, the switch comprising:

a rotatable knob for selecting the switch positions and including a cavity disposed therein, the cavity having an open end and a closed end;

a circuit board;

a plurality of stationary first contacts disposed in the circuit board;

a second contact including a plurality of contact arms configured to move relative to the first contacts when the knob is rotated, and to electrically connect at least two of the first contacts when the knob is rotated to a predetermined position;

an electrically insulating carrier member including an elongate portion at least partially disposed, and linearly movable, within the knob cavity, the carrier member cooperating with the second contact and the knob such that rotation of the knob to select the switch positions effects an associated rotation of the second contact arms such that when the knob is in a first position, the second contact closes a first switch and when the knob is in a second position, the second contact closes a second switch; and a biasing member disposed in the knob cavity between the closed end of the cavity and the elongate portion of the carrier member for imparting a contact force to the second contact through the carrier member, thereby facilitating electrical contact between the second contact arms and the first contacts.

16. The electrical switch of claim 15, further comprising:

a housing configured to cooperate with the knob to facilitate rotation of the knob relative to the housing, and to inhibit linear movement of the knob in a direction opposite the direction of the contact force; and a cover configured to cooperate with the housing to at least substantially enclose the circuit board, the carrier member, and the second contact.

17. The electrical switch of claim 15, wherein one of the knob and the housing includes a attachment structure and the other one of the knob and the housing includes a receiving structure configured to receive the attachment structure to inhibit linear movement of the knob in at least one direction and to facilitate rotation of the knob relative to the housing.

18. The electrical switch of claim 15, wherein each of the second contact arms is cantilevered at the carrier member such that a distal end of each of the second contact arms is configured to contact, and thereby electrically connect with, a corresponding first contact.

19. The electrical switch of claim 15, wherein the housing includes a translucent polymeric material, thereby facilitating backlighting of the housing to indicate the switch positions.

20. The electrical switch of claim 15, wherein one of the knob cavity and the elongate portion of the carrier member includes a projection along a portion of its length and the other one of the knob cavity and the elongate portion of the carrier member includes a channel configured to receive the projection, the projection and channel being configured to facilitate linear movement of the carrier member relative to the knob and to facilitate substantially synchronous rotational movement of the knob and the carrier member.

* * * * *